United States Patent [19]

Gregorich et al.

[11] Patent Number: 4,953,698

[45] Date of Patent: Sep. 4, 1990

[54] UNITARY CARTON SYSTEM FOR FANS

[75] Inventors: Daniel A. Gregorich; Frank E. Breining, both of Jackson, Mich.

[73] Assignee: Airmaster Fan Company, Jackson, Mich.

[21] Appl. No.: 487,456

[22] Filed: Feb. 14, 1990

[51] Int. Cl.[5] ..... B65D 85/68

[52] U.S. Cl. ..... 206/319; 206/320; 206/521

[58] Field of Search ..... 53/449; 206/319, 320, 206/521, 577, 585, 587, 589

[56] References Cited

U.S. PATENT DOCUMENTS

| | | | |
|---|---|---|---|
| 1,667,887 | 5/1928 | Fallert | 206/320 |
| 1,712,782 | 5/1929 | White | 206/320 |
| 3,305,081 | 2/1967 | Broecker | 206/319 |
| 3,414,121 | 12/1968 | Suzuki | 206/320 |
| 4,166,531 | 9/1979 | Fujiwara | 206/320 |
| 4,300,677 | 11/1981 | Szabo | 206/521 |
| 4,640,419 | 2/1987 | Yang | 206/320 |
| 4,828,115 | 5/1989 | Wiegand et al. | 206/320 |

FOREIGN PATENT DOCUMENTS

| | | | |
|---|---|---|---|
| 0111679 | 4/1989 | Japan | 206/521 |

*Primary Examiner*—Jimmy G. Foster

*Attorney, Agent, or Firm*—Beaman & Beaman

[57] ABSTRACT

A unitary carton system for column supported air circulating fans wherein a plurality of fan components may be shipped in disassembled form in a single carton of concise size acceptable by package delivery services. Nested fan blade guards, a column supporting base, and a fan blade assembly are stacked within a carton and maintained in position by column structure which includes an inner carton, and the fan motor is located within a corner region. The carton cover maintains the column structure within its support, which in turn, contains the stacked components in a predetermined relationship.

10 Claims, 2 Drawing Sheets

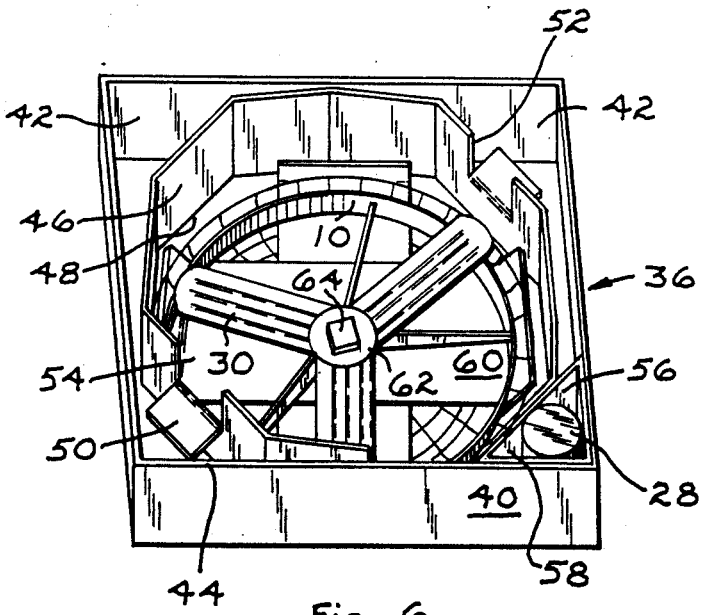
Fig 6
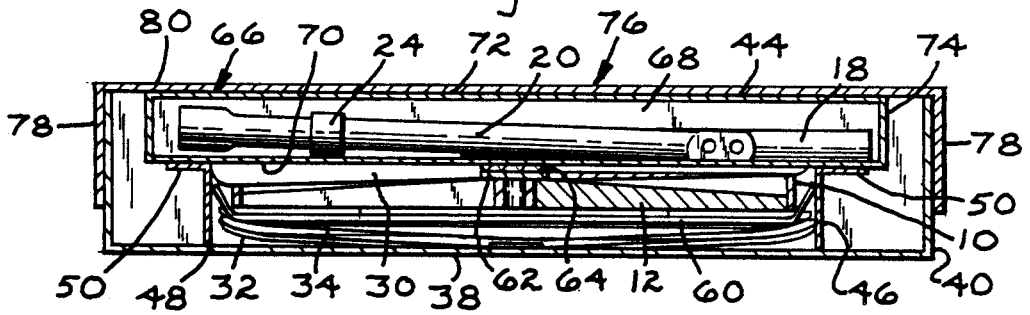
Fig 7
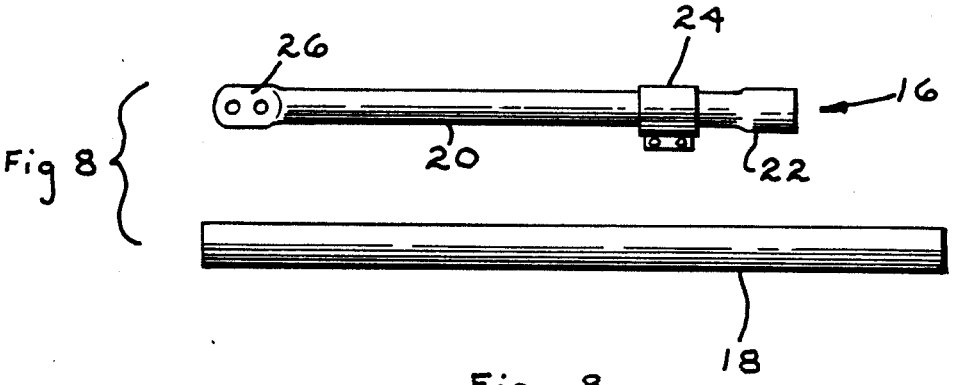
Fig 8
Fig 8

UNITARY CARTON SYSTEM FOR FANS

BACKGROUND OF THE INVENTION

Column or pedestal mounted air circulation fans commonly consist of a base, a column supported upon the base at its lower end, and the column upper end supports a motor having a drive shaft upon which a blade assembly is affixed, and blade guards mounted upon the motor housing encompass and protect the blade assembly. Fans of this type, particularly of larger size as used in industrial and institutional applications are difficult to package and ship, and, conventionally, it is the practice to ship such column or pedestal type fans in several cartons.

The shipping of fans in a plurality of separate cartons is expensive, and creates the likelihood that only a partial order will be received. Lost, displaced or delayed components prevent use of the apparatus until all of the components are available.

As industrial and institutional air circulation fans are often shipped by package delivery services, such as United Parcel Service (UPS) it is necessary to comply with the package size limitations of such delivery services, and large size air circulation fans wherein the fan motor is supported upon an elongated pedestal or column usually require at least three separate cartons in order to qualify for delivery service. Heretofore, it has not been possible to ship all of the components of a column supported commercial type air circulation fan in a single carton which qualifies under conventional package delivery service standards.

It is an object of the invention to provide a unitary shipping carton for column supported air circulating fans wherein all of the components of the fan may be contained within a single carton which meets standard package delivery service regulations.

Another object of the invention is to provide a unitary carton for shipping column supported fans wherein the fan components will be retained within the carton in such manner as to protect the components from damage and wherein the fan components will not be stressed, bent or otherwise abused by the packaging during shipping.

Yet another object of the invention is to permit a column supported floor mounted fan to be shipped in a single carton in a disassembled manner wherein the fan components interrelate such that the components will be maintained in the desired relationship to each other and the carton during shipping, and wherein the closing of the carton locks the components in the desired relationship within the shipping carton.

In the practice of the invention a rectangular carton, preferably square, includes an annular divider of a generally circular configuration which receives a pair of nested concave-convex fan blade guards, the concave side of the fan blade guards being disposed toward the carton open end. A base for supporting the fan column is of such a diameter as to fit within the nested fan blade guards, and the fan blade assembly is superimposed over the base in a concentric relationship.

The annular carton divider includes ledges located adjacent opposed corners of the carton for receiving column structure which consists of a elongated carton containing the fan column. The column structure includes a side disposed toward the blade assembly which engages the hub of the blade assembly, and the opposite side of the column structure is in substantial alignment with the plane of the carton open end. Accordingly, the column structure will be disposed diagonally across the carton locating the column structure within the carton maximum dimension.

At one of the carton interior corner regions not in alignment with the column structure motor receiving and confining means in the form of a triangular divider is located. Upon a cover being applied to the open end of the carton the column structure will be engaged maintaining the same in a superimposed contiguous relationship to the stacked blade guards, base and blade assembly rendering the contents firmly positioned within the carton for safe shipping.

The fan column may consist of a plurality of telescoping members wherein a fan of substantial height may be shipped with the carton system of the invention and by the practice of the inventive concepts it is possible to ship a commercial type circulating fan by parcel delivery services and maintain the carton within the package limitations of such services.

BRIEF DESCRIPTION OF THE DRAWINGS

The aforementioned objects and advantages of the invention will be appreciated from the following description and accompanying drawings wherein:

FIG. 6 is a perspective view of the carton after locating the blade assembly upon the column supporting base, FIG. 7 is an elevational sectional view of the fully packed carton as taken along section 7—7 of FIG. 3, the cover being shown in its installed relationship, and FIG. 8 is an elevational view of a two part fan column of the type used to support a circulating fan shipped in the carton of the invention.

DESCRIPTION OF THE PREFERRED EMBODIMENT

Figure 1:
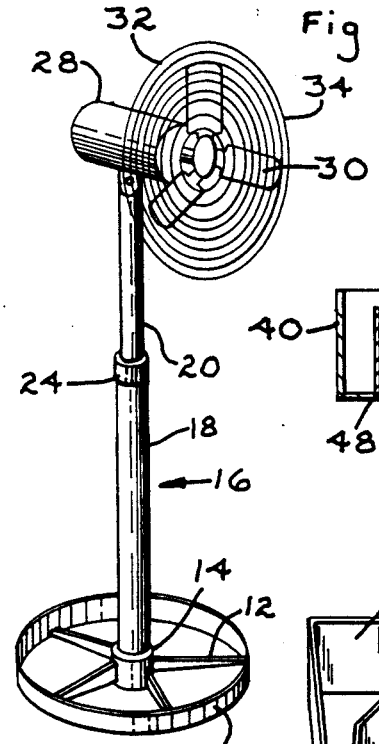
FIG. 1 is a perspective view of a typical assembled commercial air circulating fan of the type shipped in accordance with the unitary carton system of the invention.

A floor mounted column supported air circulating fan of the typical commercial type is shown in FIG. 1. Such a fan consists of a circular base 10 including spokes 12 and a hub 14 having a socket defined therein for receiving the lower end of the cylindrical column 16. The column 16 may consist of a plurality of telescoping parts, and in the practice of the invention a full sized floor mounted fan will utilize a two part column. With reference to FIG. 8, a typical two part column consists of a lower tubular portion 18, and the upper tubular portion 20 includes an enlarged cylindrical end 22 adapted to telescopically associate with the lower portion 18, a positioning and locking collar 24 is mounted on portion 20, and at its upper end 26 the portion 20 is flattened and has screw receiving holes for supporting the fan motor 28 thereon in an adjustable manner, as well known.

The fan motor 26 includes a drive shaft upon which the blade assembly 30 is mounted, and the rotating blades are located within a two part blade guard which is mounted upon the housing of motor 28. The blade guard consists of a pair of concave-convex welded wire portions 32 and 34 interconnected to securely enshroud the blade assembly 30, and blade guards of this type are disclosed in the assignee's U.S. Pat. No. 4,861,230.

For shipping purposes, the base 10, column portions 18 and 20, motor 28, blade assembly 30, and blade guard portions 32 and 34 are disassembled resulting in seven separate components. It is in this disassembled relationship that the fan components are shipped in the carton constructed in accord with the invention.

The carton 36 of the invention includes a flat bottom panel 38 of rectangular configuration from which upstanding side walls 40 extend to form corner regions 42. The carton 36 is usually formed of conventional corrugated cardboard and is shaped by conventional fabrication techniques. The carton is of a rectangular configuration, preferably square, and the upper end 44 of the carton as defined by the upper edges of side walls 40 is planar and is open as will be appreciated from the figures. It is to be understood that the terms "upper" and "lower" as used in this specification are used relative to the illustrations of the drawings and the manner in which the carton is packed, and such terms are not to be interpreted in a limiting manner as the orientation of the completed carton to the vertical may change during handling and shipment.

Figure 4:
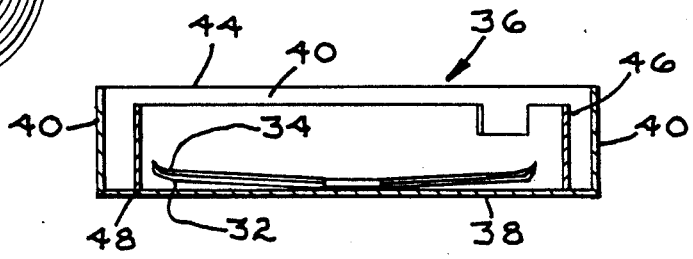
FIG. 4 is an elevational sectional view illustrating the location and positioning of the fan blade guards within the carton prior to the carton receiving the other fan components.

An annular divider generally indicated at 46 is located within the carton 36, and is of a generally circular configuration, but specifically, is formed of a plurality of flat portions to define its circumference. The divider includes a lower edge 48 which engages the bottom panel 38, and preferably, the upper edge of the divider 46 is in substantial alignment with the plane of the carton open end 44, as apparent in FIG. 4.

Figure 2:
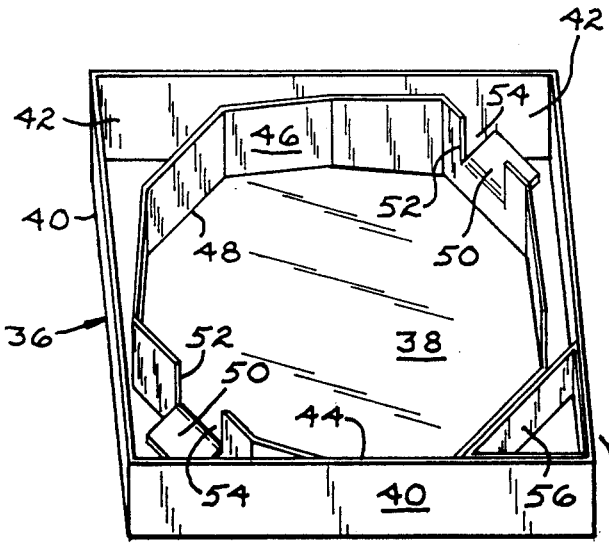
FIG. 2 is a perspective view of the carton and annular divider prior to any fan components being located therein.

Adjacent to two opposed corner regions 42 defined by intersecting sidewalls 40 the divider 46 is formed with ledges 50, FIG. 2, for supporting the column structure as will be later appreciated. The ledges 50 extend outwardly toward the associated corner region and as the ledges are cut from the divider the cut edges 52 form a notch 54 above the ledges.

A triangular cardboard divider 56 is placed in one of the corner regions 42 not adjacent a ledge 50. In the drawings the triangular divider 56 is located in the lower right hand corner, and this divider defines a compartment 58 for snugly receiving the motor 28 and its associated mounting bracket.

When packing the carton 36 the two blade guards 32 and 34 are first placed within the divider 46, and as will be appreciated from the drawings, the diameter of the blade guards is only slightly less than the diameter defined by the divider 46. The blade guards are nested in such a manner that the upper portion 34 is located within the concave side of the portion 32, and the convex side of portion 32 engages the bottom panel 38, while the concave side of portion 34 faces toward the carton open end 44.

After locating the nested blade guards 32 and 34 within the carton divider 46 a cross shaped cardboard separator 60 is placed within the uppermost blade guard 34 and the column supporting base 10 is placed upon the cross shaped separator 60. The diameter of the base 10 is less than that of the fan guards, and accordingly, the base will fit into the fan guard 34 as illustrated.

Figure 5:
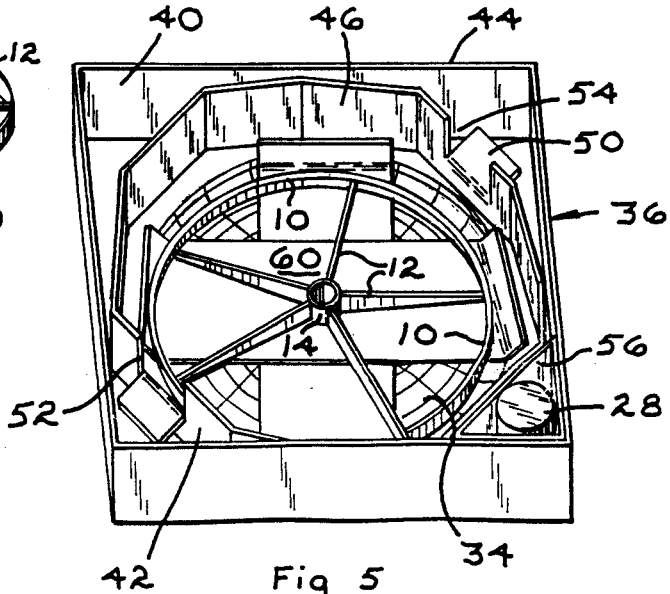
FIG. 5 is a perspective view of the partially packed carton after placing the column supporting base within the nested fan blade guards.

After the base 10 is mounted upon the separator 60 the components will be as shown in FIG. 5, and thereupon the blade assembly 30 is concentrically placed upon the base 10. As the blade assembly 30 includes a hub 62 the blade assembly hub 62 may be located upon the hub 14 of the base, and the diameter of the blade assembly 30 is only slightly greater than the diameter of the base 10.

After the blade assembly 30 is placed upon the hub 14 of the base a small foam or plastic pad 64 is placed upon the blade assembly hub 62, and thereupon, the column structure 66 is placed into the carton.

The column structure 66 includes an elongated closed end cardboard carton 68 of a rectangular transverse cross-section which contains the column portions 18 and 20. The inner carton 68 includes a lower side 70 which engages the pad 64, and the upper side 72 of the carton 68 is in substantial alignment with the carton open end 44. The carton includes ends 74 for confining the column portions therein, and the horizontal width of the carton is such that the carton is snugly received within the edges 52 defining the notches 54 located within the annular divider 46. The carton lower side 70 will rest upon the ledges 50 as appreciated in FIG. 7.

Figure 3:
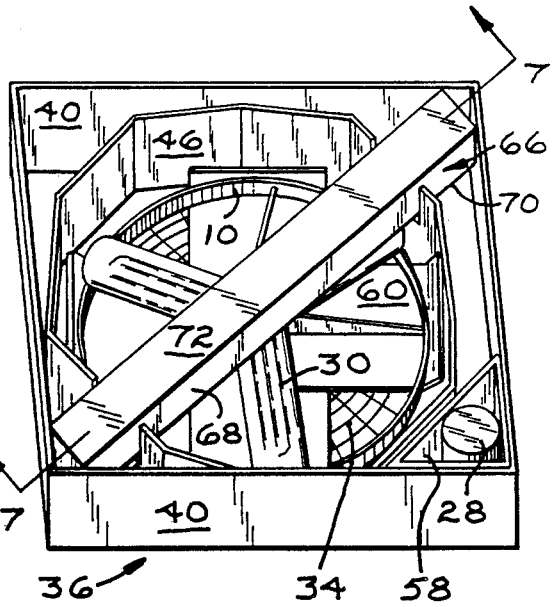
FIG. 3 is a perspective view of the carton fully packed with all of the fan components located therein, and prior to the carton cover being located thereon.

As apparent in FIG. 3 the inner carton 68 is diagonally oriented within the carton 36 taking advantage of the maximum interior carton diameter, and by forming the fan column in several portions it is possible to ship a relatively long column in concise packaging.

The carton cover 76, FIG. 7, is of a rectangular configuration complementary to the carton 36, and includes sidewalls 78 which telescope over the carton sidewalls 40, and the top panel 80 closes the carton open end 44. As the upper edge of divider 46, and the inner carton wall 72 are in alignment with the plane of the carton open end 44, these components will be engaged by the cover panel 80 and firmly retained in their proper position within the carton upon application of the cover to the carton and fixing thereon by staples, tape or other conventional packaging fastening devices.

The firm positioning and retention of the inner carton 68 within its notches 54 and upon the ledges 50 will maintain the fan guards 32 and 34, base 10 and blade assembly 30 in their stacked relationship as shown in FIG. 7, and all of the components of the fan illustrated in FIG. 1 may be concisely and safely shipped in the carton of the invention.

As the maximum dimensions of the carton 36 are such as to fall within the limitations of parcel delivery services, such as United Parcel Service, the carton of the invention permits commercial type air circulation fans to be readily shipped. As all of the fan components are located within a single carton previously encountered problems due to the use of a plurality of cartons are eliminated, and reduced costs and shipping problems are experienced.

It is appreciated that various modifications to the inventive concepts may be apparent to those skilled in the art without departing from the spirit and scope of the invention. For instance, the inner carton 68, could be eliminated wherein the column portions, directly, are received within the notches 54 and ledges 50 defined within the annular divider 46, and the cover panel 80 could directly engage the upper portion of the column sections, and it is to be appreciated that the term "column structure" includes column components which are separately packaged, or are openly contained within the carton 36.

We claim:

1. A unitary carton system for shipping a floor mounted fan consisting of a column supporting base, an elongated column, an electric motor, a fan blade assembly, and a pair of nestable blade guards each having concave and convex sides comprising, in combination, a rectangular carton having a closed bottom panel, side walls and an open upper end, intersecting side walls defining first and second pairs of opposed interior corner regions, an interior central region defined on said closed bottom panel receiving the blade guards wherein the blade guards are nested within each other such that the convex side of the blade guards is disposed toward said bottom panel and the concave side of the blade guards is disposed toward said carton open end, the column supporting base being received within the nested blade guards located adjacent the concave side of the blade guard closest to said carton open end, the fan blade assembly being located adjacent the base intermediate the base and said carton open end, column structure supporting means defined within said carton extending from said bottom panel and located between the nested blade guards and said carton side walls, column structure supporting ledges defined on said column structure supporting means adjacent said first pair of opposed corner regions whereby column structure supported on said ledges is diagonally oriented within said carton, said ledges being spaced from said bottom panel a distance whereby column structure supported upon said ledges is closely superimposed over the blade assembly, motor receiving and confining means defined in one of said second pairs of corner regions receiving a motor therein, and means maintaining said column structure upon said column structure supporting ledges whereby said column structure maintains the blade guards, base and blade assembly in the aforedescribed stacked relationship during shipping.

2. In a unitary carton system as in claim 1, said means maintaining said column structure upon said column structure supporting ledges comprising a cover superimposed over and enclosing said carton open end.

3. In a unitary carton system as in claim 1, said column structure supporting means comprising an inner divider having a first edge engaging said carton bottom panel and a second edge in substantial alignment with said carton open end.

4. In a unitary carton system as in clam 3, said divider being of an annular configuration substantially encompassing the circumference of said nested blade guards.

5. In a unitary carton system as in claim 1, said column structure including an interior carton having first and second opposed walls, the column being located within said interior carton, said interior carton first wall engaging said ledges and disposed toward said fan blade assembly and said interior carton second wall being in substantial alignment with said carton open end.

6. In a unitary carton system as in claim 5, said means maintaining said column structure upon said column structure supporting ledges comprising a cover superimposed over and enclosing said carton open end, said cover engaging said interior carton second wall.

7. In a unitary carton system as in claim 1, said motor receiving and confining means comprising a triangular divider located between intersecting carton side walls, said bottom panel and said carton structure supporting means.

8. In a unitary carton system as in claim 1 wherein said carton is of a substantially square configuration.

9. A unitary carton system for shipping a floor mounted fan consisting of a column supporting base, an elongated column, an electric motor, a fan blade assembly, and a pair of nestable blade guards each having concave and convex sides comprising, in combination, a rectangular carton having a closed bottom panel, side walls and an open upper end, intersecting side walls defining first and second pairs of opposed interior corner regions, an interior central region defined on said closed bottom panel receiving the nested blade guards, column supporting base and blade assembly in a stacked relationship, motor receiving and confining means defined in one of said interior corner regions, column structure supporting means defined within said carton, column structure supported upon said supporting means superimposed over the stacked blade guards, base and blade assembly in contiguous relationship thereto and means maintaining said column structure upon said supporting means whereby said column structure and stacked components will be retained during shipping.

10. In a unitary carton system as in claim 9, said means maintaining said column structure upon said supporting means comprising a cover extending over said carton open end.

* * * * *